US006889584B2

(12) United States Patent
Amami

(10) Patent No.: US 6,889,584 B2
(45) Date of Patent: May 10, 2005

(54) WRENCH

(75) Inventor: Tatsuya Amami, Habikino (JP)

(73) Assignee: Kuken Co., Ltd., Habikino (JP)

( * ) Notice: Subject to any disclaimer, the term of this patent is extended or adjusted under 35 U.S.C. 154(b) by 0 days.

(21) Appl. No.: 10/679,369

(22) Filed: Oct. 7, 2003

(65) Prior Publication Data

US 2004/0187651 A1 Sep. 30, 2004

(30) Foreign Application Priority Data

Mar. 24, 2003 (JP) ..... 2003-080199

(51) Int. Cl.[7] ..... B25B 25/00
(52) U.S. Cl. ..... 81/466; 463/465; 73/1.08
(58) Field of Search ..... 81/466, 463, 465, 81/467, 468, 473, 474, 475, 477, 480, 483; 73/1.08

(56) References Cited

U.S. PATENT DOCUMENTS 4,901,610 A * 2/1990 Larson et al. ..... 81/473
D409,060 S * 5/1999 Lucy ..... D8/24

FOREIGN PATENT DOCUMENTS

JP 52-35596 3/1977

* cited by examiner

*Primary Examiner*—Joseph J. Hail, III
*Assistant Examiner*—Alvin J Grant
(74) *Attorney, Agent, or Firm*—Wenderoth, Lind & Ponack, L.L.P.

(57) ABSTRACT

A wrench includes a main shaft having a working portion provided at the top thereof; a torsion member having an elastic restoring force against torsion about the axis of the main shaft; at least one operating handle disposed so as to intersect with the middle of the main shaft; and torque display means for displaying a torque produced in accordance with the degree of twist of the torsion member with respect to the reference point of the same. The main shaft is dividable into two divided bodies in the axial direction thereof, and the two divided bodies are connected to each other. The torsion member is interposed between the divided bodies, which are turnable relative to each other about the axis of the main shaft. With this wrench, a screw can be quickly sent to its seating position and is then fastened with up to a predetermined torque.

13 Claims, 4 Drawing Sheets

WRENCH

BACKGROUND OF THE INVENTION

1. Field of the Invention

The present invention relates to a wrench used for attaching and detaching, for example, a screw for fixing an automobile wheel.

2. Description of the Related Art

A cross limb wrench has been used for attaching and detaching a screw for fixing an automobile wheel, as disclosed in Japanese Unexamined Utility Model Registration Application Publication No. 51-74299.

The cross limb wrench includes a main shaft having a working portion such as a socket attached at the top thereof, which is fitted onto the head of a screw, and an operating handle disposed so as to perpendicularly intersect with the middle of the main shaft. In the case where the screw is to be fastened, when the working portion is set on the screw head and a turning force is then applied on the operating handle by one hand while the rear of the main shaft is lightly supported by the other hand, the main shaft is continuously turned with the inertia force of the operating handle so that the screw is quickly sent to its seating position.

Although the screw is fastened with up to a predetermined torque for the last time, when the screw is further fastened by still using the cross limb wrench, a torque of the cross limb wrench applied on the screw varies, thereby causing a risk that the screw is excessively fastened and consequently twisted off.

Conventionally, in order to avoid the above risk, when the screw is quickly sent to its seating position with the cross limb wrench as mention above, the cross limb wrench is replaced with a torque wrench having a screw-driver shape as disclosed in Japanese Examined Utility Model Registration Application Publication No. 39-12785 or an L-shape, and the screw is then fastened up to the predetermined torque.

Unfortunately, this method has problems because of the troublesome work for exchanging one wrench with another and the necesity of an additional storing place and cost for one of two kinds of wrenches required to be prepared.

SUMMARY OF THE INVENTION

In view of the above-described problems, the present invention has been made. Accordingly, it is an object of the present invention to provide a wrench only with which a screw is quickly sent to its seating position and is then fastened with up to a predetermined torque.

In order to achieve the above object, a wrench according to the present invention includes a main shaft having a working portion provided at the top thereof; a torsion member having an elastic restoring force against torsion about the axis of the main shaft; at least one operating handle disposed so as to intersect with the middle of the main shaft; and torque display means for displaying a torque produced in accordance with the degree of twist of the torsion member with respect to the reference point of the same. The main shaft is dividable into two divided bodies in the axial direction thereof, and the two divided bodies are connected to each other, having the torsion member interposed therebetween, so as to be turnable relative to each other about the axis of the main shaft.

Since the wrench according to the present invention has the above structure, a screw can be quickly sent to its seating position and is also fastened with up to a predetermined torque with such a single wrench. As a result, a troublesome work for exchanging one wrench with another is eliminated, thereby improving the workability of an operator, and also the operator suffices to purchase only a single kind of tools, thereby reducing a cost and a storing place for the tools.

The wrench according to the present invention may further include turn-regulating means for regulating a relative turning angle between the two divided bodies.

When the wrench has the above-mentioned structure, the torsion member does not experience an excessive torsion and is accordingly prevented from damage.

Although the torsion member has no limitation regarding its shape as long as it has an elastic restoring force against torsion about the axis of the main shaft, examples of the shape include a rod-shape, a plate shape, a coil spring shape, and a cylindrical shape.

Also, the torsion member may be accommodated in the main shaft or exposed to the outside of the same.

In addition, when the torsion member has a cylindrical shape such as a coil spring, the main shaft may have a double structure formed by a core which is inserted into the torsion member and a cylindrical cover which covers the torsion member from outside.

DESCRIPTION OF THE PREFERRED EMBODIMENTS

Preferred embodiments of the present invention will be described in detail with reference to the accompanying drawings.

FIGS. 1 to 4 illustrate a wrench A according to a first embodiment of the present invention.

Figure 1:
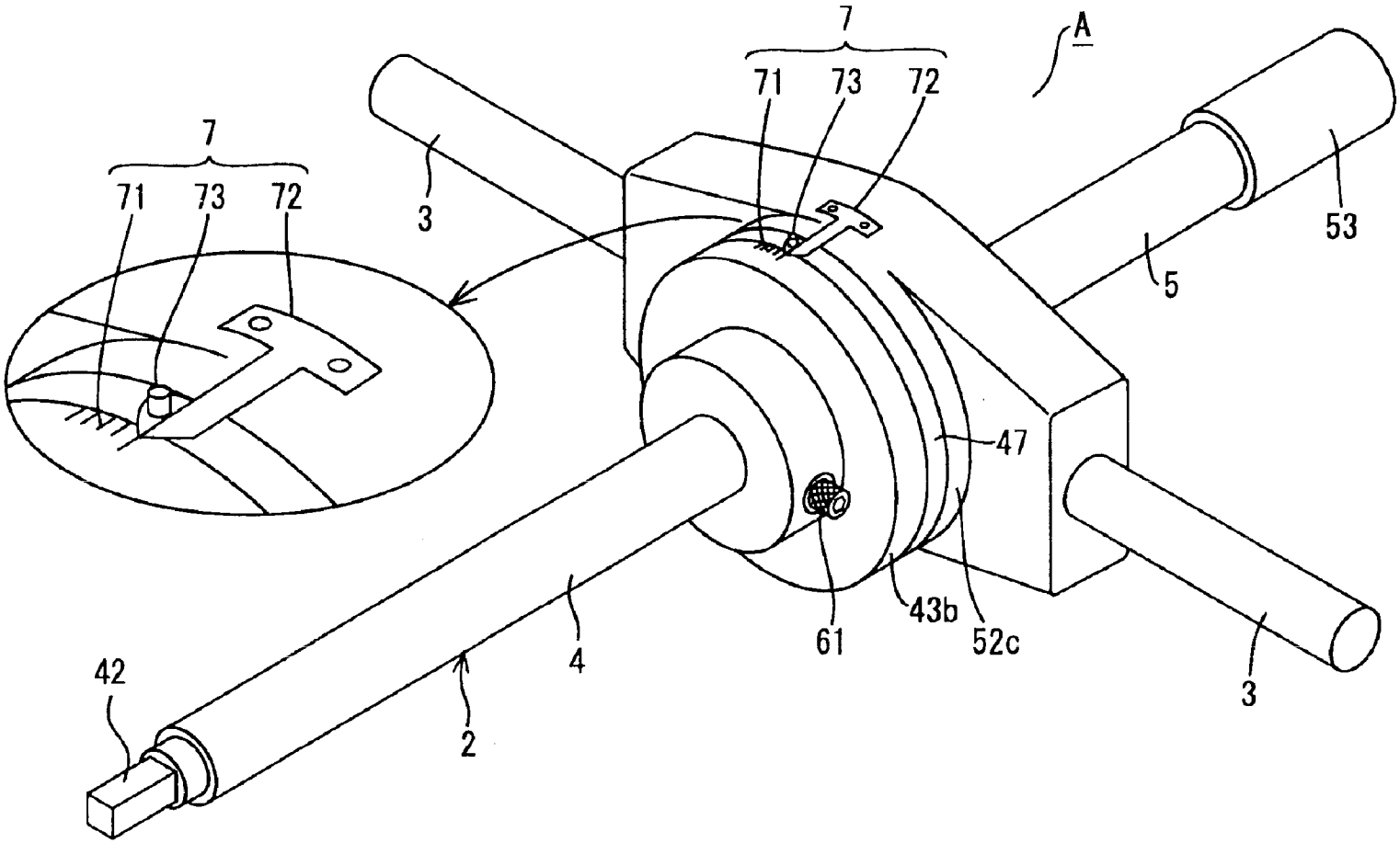
FIG. 1 is a perspective view of a wrench according to a first embodiment of the present invention.
Figure 2:
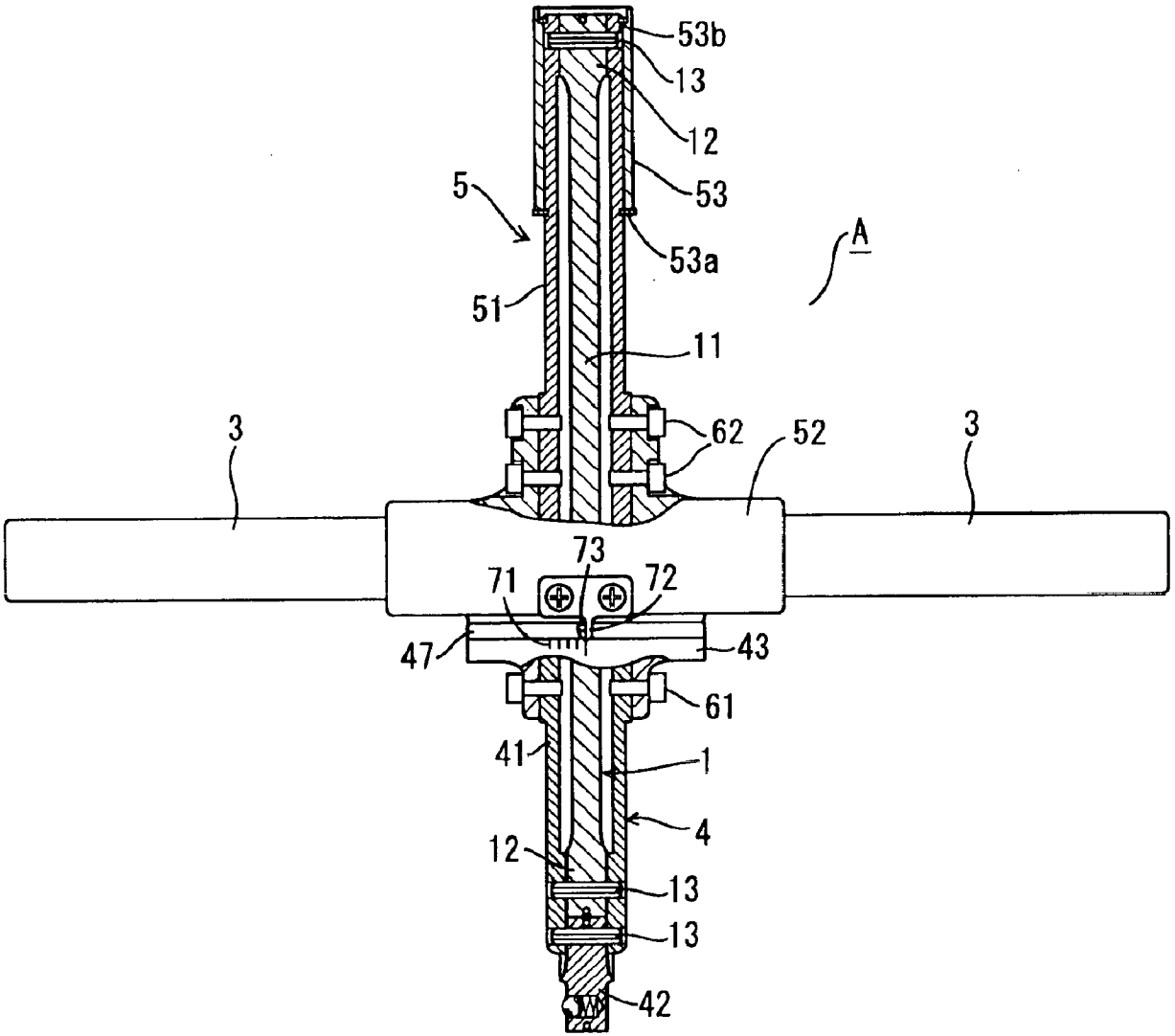
FIG. 2 is an elevation view, partly a cutaway view in section, of the wrench shown in FIG. 1.

As shown in FIGS. 1 and 2, the wrench A includes a torsion member 1, a main shaft 2, two handles 3 serving as operating handles, and torque display means 7.

The torsion member 1 is composed of a known (and generally-used) material or the like and has a rod shape. Also, the torsion member 1 includes a twist portion 11 and fixing portions 12 formed at both ends of the twist portion 11 and having a greater diameter than that of the twist portion 11. The torsion member has an elastic restoring force against torsion about its axis.

The main shaft 2 includes a first divided body 4 and a second divided body 5 fixed to the first divided body 4 so as to be rotatable about its axis.

The first divided body 4 includes a main portion 41, a socket-attaching member 42 serving as a working portion onto which a socket (not shown) is detachably attached, and a receiving member 43.

The main portion 41 has a cylindrical shape having an inner diameter substantially the same as the diameter of the fixing portions 12 of the torsion member 1; the socket-attaching member 42 fixed at one end thereof; and two projections 44 symmetrically formed at the other end thereof, serving as a part of turn-regulating means. Also, the main portion 41 has a part (a lower part when viewed in FIGS. 2 and 3) of the torsion member 1 inserted therein; and one of the fixing portions 12 of the torsion member 1 fixed thereto in the vicinity of the socket-attaching member 42 with a grooved pin 13.

The receiving member 43 includes a cylindrical portion 43*a* and a flange 43*b* extending out from the middle of the cylindrical portion 43*a* with respect to the axial direction thereof.

The cylindrical portion 43*a* is fitted onto the main portion 41, a part of the cylindrical portion 43*a* extending from the flange 43*b* towards the socket-attaching member 42 is fixed to the main portion 41 with fixing screws 61, and the other part of the cylindrical portion 43*a* extending from the flange 43*b* towards the second divided body 5 has a ring-shaped member 47 rotatably fitted thereonto. The ring-shaped member 47 is supported on a surface, facing the second divided body 5, of the flange 43*b* with a retaining ring 46.

As shown in FIG. 2, one end of the socket-attaching member 42 is inserted into one end of the main portion 41 and fixed to the main portion 41 with another grooved pin 13.

The second divided body 5 includes a main portion 51, a handle-fixing portion 52, and a cylindrical member 53.

Figure 3:
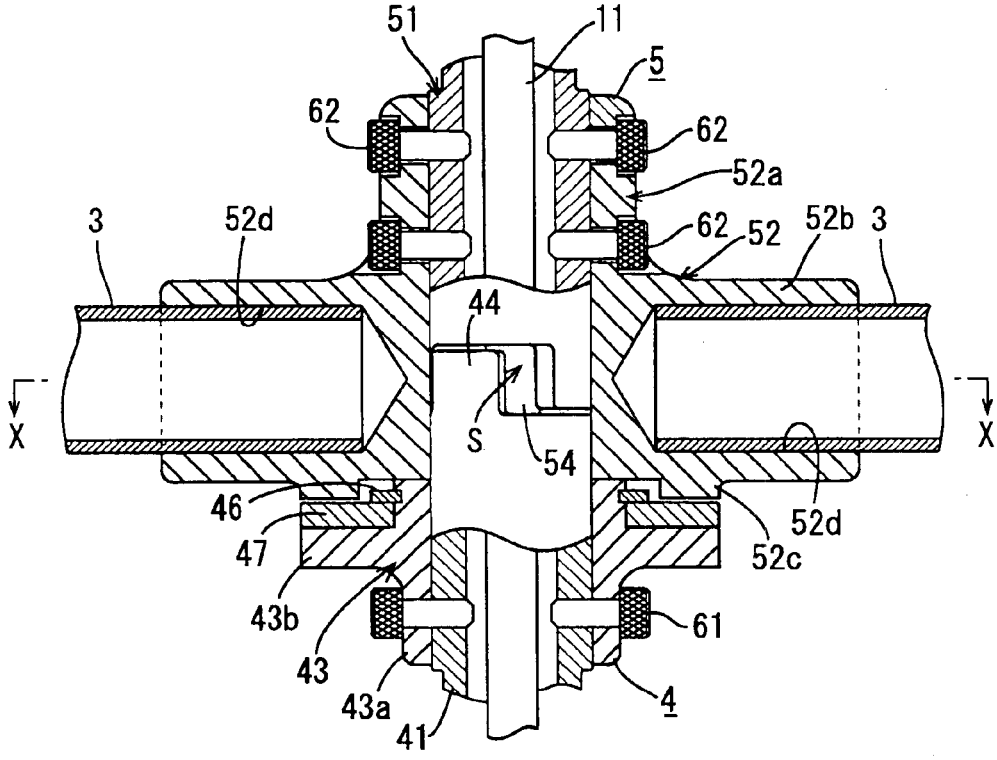
FIG. 3 is a longitudinal view partly in section of a connecting part between first and second divided bodies of the wrench shown in FIG. 1.
Figure 4:
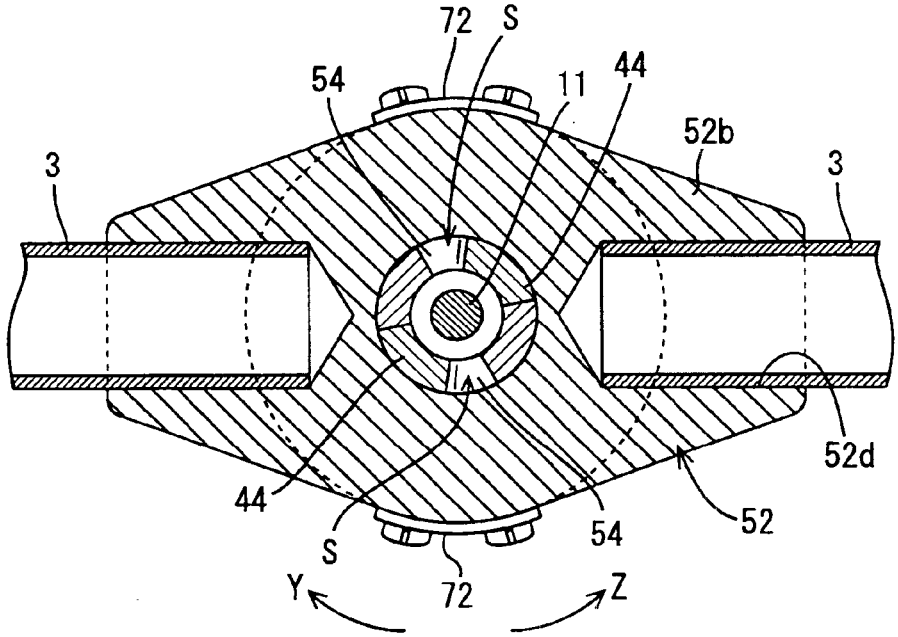
FIG. 4 is a sectional view of the wrench taken along the line X—X indicated in FIG. 3.

As shown in FIGS. 3 and 4, the main portion 51 has a cylindrical shape having an inner diameter substantially the same as the diameter of the fixing portions 12 of the torsion member 1; two cuts 54 symmetrically formed at one end thereof, serving as the remaining part of the turn-regulating means, into which the projections 44 of the main portion 41 of the first divided body 4 are freely fitted; the remaining part (an upper part when viewed in FIGS. 2 and 3) of the torsion member 1 inserted therein; and the other fixing portion 12 of the torsion member 1 fixed thereto with another grooved pin 13.

The two cuts 54 have the corresponding projections 44 inserted therein. Also, in a state in which torsion is not applied on the torsion member 1, the two cuts 54 are symmetrically disposed such that one wall of each cut 54 facing toward the screw-loosening direction (the direction of arrow Z indicated in FIG. 4) lies in contact with one wall of the corresponding projection 44, and also the other wall of the cut 54 facing toward the screw-fastening direction (the direction of arrow Y indicated in FIG. 4) and the other wall of the projection 44 have a clearance S formed therebetween.

Each clearance S is formed so as to have a size such that, even when the twist portion 11 of the torsion member 1 is twisted, the wall of the cut 54 facing toward the screw-fastening direction comes into contact with the other wall of the corresponding projection 44 at a twisted position of the torsion member 1 where an excessive torque is not exerted thereon.

The handle-fixing portion 52 includes a cylindrical portion 52*a*, two handle-engaging portions 52*b*, and a skirt portion 52*c*.

The cylindrical portion 52*a* is fitted onto the main portion 51 and is fixed thereto with fixing screws 62.

The two handle-engaging portions 52*b* symmetrically extend out from the wall of the cylindrical portion 52*a* and have corresponding handle-engaging holes 52*d* perforated therein, and one end of each of the cylindrical handles 3 having the same length as each other is firmly fitted into the corresponding handle-engaging hole 52*d*.

The skirt portion 52*c* has a ring shape having substantially the same outer diameter as that of the flange 43*b*, extends out from a surface of the handle-fixing portion 52 facing toward the first divided body 4, and covers the retaining ring 46 so as to be invisible from outside.

The cylindrical member 53 is freely fitted onto the main portion 51 so as to be rotatable around the main portion 51 while its movement along the axial direction of the main portion 51 is regulated with retaining rings 53*a* and 53*b*.

The torque display means 7 includes scales 71, pointers 72, and friction pointers 73.

In order to visually check the degree of torsion of the torsion member 1, the scales 71 are symmetrically disposed on the outer circumferential surface of the flange 43*b* while being displaced by 180 degrees with respect to each other, although only one of the scales 71 is illustrated in the figure.

The end of each pointer 72 is fixed to the wall of the handle-fixing portion 52, displaced by about 90 degrees relative to the handle-engaging portions 52*b* so that its needlepoint points a position indicating zero on the corresponding scale 71 in a state in which a torque is not exerted on the torsion member 1.

The friction pointers 73 are fixed on the outer circumferential surface of the ring-shaped member 47 and turn around the cylindrical portion 43*a* together with the ring-shaped member 47.

Usage of the wrench A will be described in detail.

When a screw (not shown) is to be fastened, a socket (not shown), which is compatible to the screw, is first attached to the socket-attaching member 42.

When the socket has the screw inserted therein, the cylindrical member 53 is held by one hand, one of the handles 3 has a turning force applied thereon by the other hand in the screw-fastening direction (the direction of arrow Y indicated in FIG. 4), and the main shaft 2 is continuously turned with the inertia force of the handle 3 so that the screw is quickly sent to its seating position.

When the screw is sent to its seating position, the friction pointers 73 are kept in almost contact with the corresponding pointers 72, both handles 3 are held by both hands, the second divided body 5 is turned relative to the first divided body 4 until the needle point of each pointer 72 reaches a predetermined position on the corresponding scale 71 while the needlepoint of one of the pointers 72 is being observed, and the screw is thus fastened.

In other words, since the main shaft 2 is dividable into the first and second divided bodies 4 and 5, and also the first and second divided bodies 4 and 5 are connected with the torsion member 1, the twist portion 11 of the torsion member 1 is twisted so as to turn the second divided body 5 relative to the first divided body 4 in the fastening direction. Thus, the screw is fastened with a torque corresponding to an elastic restoring force generated in accordance with the degree of torsion of the torsion member 1, corresponding to a position on the scale 71 pointed by the needlepoint of the corresponding pointer 72. Also, since the ring-shaped member 47 is rotatable with respect to the cylindrical portion 43*a*, when each pointer 72 turns together with the second divided body 5, the corresponding friction pointer 73 is pushed by the pointer 72 so as to move to the same position as that of the needlepoint of the pointer 72.

When the screw is completely fastened, the forces exerted on the handles 3 are eased. When the forces exerted on the handles 3 are eased, the second divided body 5 is returned to its original unfastened state with an elastic restoring force of the torsion member 1. Each pointer 72 are also returned to its original unfastened state while leaving the corresponding fiction pointer 73 at a position on the corresponding scale 71, indicating the maximum torque exerted at the time of fastening.

When a screw is to be loosened, in the same fashion as with a normal wrench, the socket has the screw inserted therein, the handles 3 are held by both hands, and the main shaft 2 is turned in the screw-loosening direction (the direction of arrow Z indicated in FIG. 4). When the screw is loosened to a certain extent, by holding the cylindrical member 53 by one hand and by applying a turning force on one of the handles 3 by the other hand in the screw-loosening direction, the main shaft 2 is continuously turned with the inertia force of the handle 3 so that the screw is quickly loosened.

As described above, with this wrench A, a screw can be quickly sent to its seating position in the same fashion as with a known cross limb wrench, and also the screw can be fastened with up to a predetermined torque without replacing this wrench with another torque wrench.

Also, since the walls of the cuts 54 facing toward the screw-loosening direction lie in contact with the walls of the corresponding projections 44 in an unloaded state, that is, in a state in which the torsion member 1 is not twisted, a force exerted on one of the handles 3 is directly exerted from the walls of the cuts 54 of the second divided body 5 to the walls of the corresponding projections 44. That is, when a screw is to be loosened, the force is directly transmitted from the second divided body 5 to the first divided body 4 without exerting a torsional force on the torsion member 1. As a result, even when the screw is firmly fastened, the torsion member 1 does not experience an excessive torque and is not hence damaged.

In addition, when a screw is to be fastened, even when the twist portion 11 of the torsion member 1 is twisted, since the clearances S are formed so as to have a size such that the walls of the cuts 54 facing toward the fastening direction come into contact with the other walls of the corresponding projections 44 at respective positions where an excessive torque is not exerted on the torsion member 1, the walls of the cuts 54 facing towards the fastening direction are received by the walls of the corresponding projections 44 facing toward the fastened direction before an excessive torque is exerted on the torsion member 1, and a force is directly transmitted from the second divided body 5 to the first divided body 4. As a result, the torsion member 1 does not experience an excessive torque and is not hence damaged.

Also, since the cylindrical member 53 is rotatably fitted onto the top of the main portion 51 of the second divided body 5, when the cylindrical member 53 is held by one hand, the main shaft 2 is easily turned.

In addition, since the friction pointers 73 are provided, after completion of fastening a screw, it can be checked whether the screw is fastened with a proper torque.

Figure 5A:
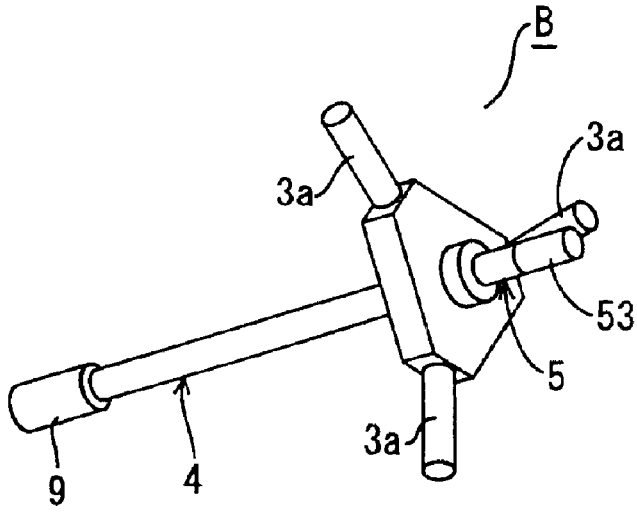
FIGS. 5A and 5B are perspective views of wrenches according to second and third embodiments of the present invention.
Figure 5B:
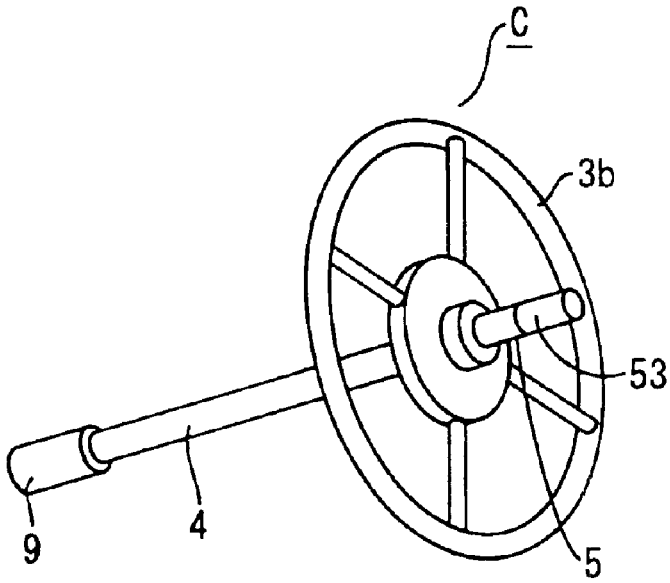

FIGS. 5A and 5B illustrate wrenches B and C according to second and third embodiments of the present invention.

The wrench B shown in FIG. 5A has the same structure as that of the wrench A except that a socket 9 serving as a working portion is integrally formed with the top of the first divided body 4 and that three handles 3*a* are formed so as to extend radially with respect to the main shaft 2.

Meanwhile, the wrench C shown in FIG. 5B has the same structure as that of the wrench A except that the socket 9 serving as a working portion is integrally formed with the top of the first divided body 4 and that a ring-shaped handle 3*b* is substantially coaxially formed with the main shaft 2.

Wrenches according to the present invention are not limited to those according to the foregoing embodiments. For example, although, in the foregoing embodiments, an exerted torque is read with a position on the scale pointed by the pointer 72, that is, the exerted torque is read by observing a twist angle of the torsion member 1, the exerted torque may be electrically displayed by bonding strain gauges or the like on the torsion member, or by disposing a non-contact magnetostrictive torque sensor (e.g., Torqueducer (trademark) made by Kubota Corporation) in a groove formed in the torsion member.

Although the two handles 3 have the same strength as each other in the first embodiment, since the wrench is turned at a relatively low speed, their lengths may be different from each other as long as the main shaft can be turned in a well-balanced manner.

Also, although each handle 3 is firmly fitted into the corresponding handle-engaging hole 52*d* in the first embodiment, the handle 3 may be detachably fixed by a screw or the like, or may be fixed to the corresponding handle-fixing portion via a hinge so as to be foldable along the main shaft.

In addition, although the cylindrical member 53 is freely fitted onto the main portion 51 in the foregoing embodiments, a bearing may be interposed therebetween. Also, the cylindrical member may be eliminated as long as the circumferential surface of the main portion is formed so as to be less frictional.

Furthermore, although, in the foregoing embodiments, each clearance S is formed only between the wall of the cut 54 facing toward the fastening direction and the other wall of the corresponding projection 44 in an unloaded state, two clearances may be formed so as to face both walls of each projection. With this structure, either of right and left hand screws can be fastened with up to a predetermined torque. Also, in addition to the clearances formed at both sides of the projection as mentioned above, when handles are provided not only at the side of the second divided body but also at the side of the first divided body, working portions can be provided not only at the side of the first divided body but also at the side of the second divided body. Thus, for example, when sockets of the first and second divided bodies having different sizes from each other are set, upon completion of fastening a screw according to the above-described usage, another screw having a different diameter from that of the former screw can be fastened by turning the wrench upside down, holding the handle at the side of the first divided body, and performing the same operation as that applied to the former screw.

Although the socket is attached to the corresponding working portion in each of the foregoing embodiments, a tip of a screw-driver may be fixed thereat.

What is claimed is:

1. A wrench comprising:

a cylindrical main shaft comprised of a first divided body having a working portion and a second divided body having an operating handle extending from a portion of the second divided body, wherein the first and second divided bodies are connected so as to be capable of rotational movement relative to each other;

a torsion member having a first end, a second end and a twist portion between the first and second ends, said torsion member being inserted in the first and second divided bodies of the main shaft, and providing an elastic restoring force about the axis of the main shaft upon twisting the twist portion by torsion applied to the second divided body, wherein a first end of the first divided body is fixed to the first end of the torsion member, and a first end of the second divided body is fixed to the second end of the torsion member;

a cylindrical member rotatably disposed on the second divided body; and torque display means for displaying the torque produced in accordance with the degree of twist of the torsion member with respect to a reference point.

2. The wrench as claimed in claim 1, further comprising turn-regulating means for regulating a relative turning angle between the first and second divided bodies, said turn regulating means comprising an engaging portion formed at a second end of the first divided body and an engaging portion formed at a second end of the second divided body, wherein the engaging portions are engaged with each other when a predetermined torque in a screw-fastening direction is applied to the torsion member, and the engaging portions do not engage with each other until the predetermined torsion in the screw-fastening direction is applied.

3. The wrench as claimed in claim 2, wherein, when torsion is applied to the torsion member in a screw-loosening direction, the engaging portions, which are in contact with each other in an unloaded state, are engaged.

4. The wrench as claimed in claim 2, wherein the engaging portions project in an axial direction of the main shaft so as to confront each other in a radial direction about the main shaft.

5. The wrench as claimed in claim 4, wherein, when torsion is applied to the torsion member in a screw-loosening direction, the engaging portions, which are in contact with each other in an unloaded state, are engaged.

6. The wrench as claimed in claim 1, wherein the first divided body comprises a socket attaching member onto which a socket can be attached.

7. The wrench as claimed in claim 1, wherein the torsion member is formed of an elastically deformable material.

8. The wrench as claimed in claim 1, wherein the torque display means comprises a scale provided at the second end of the first divided body, a pointer provided at the second end of the second divided body, a ring-shaped member rotatably fitted onto the second end of the first divided body, and a friction pointer fixed on the ring-shaped member, wherein, during a fastening operation, the friction pointer is pushed by the pointer and turns together with the pointer in the fastening direction, and during a loosening operation, the friction pointer does not move.

9. A wrench comprising:

a hollow cylindrical main shaft comprised of a first divided body having a working portion and a second divided body having an operating handle extending therefrom, wherein said first and second divided bodies are connected so as to permit rotational movement relative to each other;

an elastic torsion member inserted in the first and second divided bodies of the main shaft, said torsion member being capable of twisting about the axis of the main shaft and providing an elastic restoring force against torsion about the axis of the main shaft, wherein a first end of the first divided body is fixed to a first end of the torsion member, and a first end of the second divided body is fixed to a second end of the torsion member;

a cylindrical member rotatably disposed on the second divided body; and a torque display device for displaying a torque produced in accordance with the degree of twist of the torsion member with respect to a reference point, wherein the torque display device comprises a scale provided at a second end of the first divided body, a pointer provided at a second end of the second divided body, a ring-shaped member rotatably fitted onto the second end of the first divided body, and a friction pointer fixed on the ring-shaped member, and wherein, during a fastening operation, the friction pointer is pushed by the pointer and turns together with the pointer in the fastening direction, and during a loosening operation, the friction pointer does not move.

10. The wrench as claimed in claim 9, further comprising turn-regulating means for regulating a relative turning angle between the first and second divided bodies, the turn regulating means comprising at least one recess formed in the second end of the second divided body, and at least one projecting portion formed at the second end of the first divided body, wherein the projecting portion is received in the recess of the second divided body such that a clearance is formed between the projecting portion and a wall of the recess in a fastening direction, wherein, when torsion is not applied, a wall of the projecting portion contacts a wall of the recess that is facing in a loosening direction, and when torsion is applied in a loosening direction, the contacted wall of the projecting portion engages the contacting wall of the recess.

11. The wrench as claimed in claim 9, wherein, during a fastening operation, the projecting portion does not engage a wall of the recess until a predetermined torsion in the fastening direction is applied to the torsion member.

12. The wrench as claimed in claim 9, wherein the torsion member is formed of an elastically deformable material.

13. The wrench as claimed in claim 9, wherein, following a fastening operation, the friction pointer indicates the maximum torque exerted during the fastening operation.

* * * * *